US007887100B1

(12) United States Patent
Paolone

(10) Patent No.: US 7,887,100 B1
(45) Date of Patent: Feb. 15, 2011

(54) METHOD AND APPARATUS FOR MATING IRREGULAR OR NON-CIRCULAR EXHAUST PORTS WITH TUBING OF A CIRCULAR CROSS SECTION IN EXHAUST FLANGE ASSEMBLIES

(75) Inventor: Gennaro Paolone, Newport Coast, CA (US)

(73) Assignee: Car Sound Exhaust Systems, Inc, Rancho Santa Margarita, CA (US)

( * ) Notice: Subject to any disclaimer, the term of this patent is extended or adjusted under 35 U.S.C. 154(b) by 0 days.

(21) Appl. No.: 12/653,143

(22) Filed: Dec. 8, 2009

(51) Int. Cl.
*F16L 39/00* (2006.01)

(52) U.S. Cl. ..... 285/124.3; 285/288.1; 285/222; 60/323; 29/890.08

(58) Field of Classification Search ..... 285/124.3, 285/124.2, 124.4, 124.5, 288.1, 141.1, 222, 285/189; 60/323; 29/890.08
See application file for complete search history.

(56) References Cited

U.S. PATENT DOCUMENTS 4,197,704 A 4/1980 Date et al.
4,500,030 A 2/1985 Gerber et al.
4,537,027 A * 8/1985 Harwood et al. ..... 60/323
4,832,383 A * 5/1989 Roussel ..... 285/416
4,959,956 A * 10/1990 Yasuda ..... 60/323
5,349,817 A * 9/1994 Bekkering ..... 60/323
5,471,835 A * 12/1995 Friedman ..... 60/323
5,761,905 A * 6/1998 Yamada et al. ..... 60/323
5,916,137 A * 6/1999 Hayashi ..... 60/323
6,062,020 A * 5/2000 Blanchet et al. ..... 60/323
6,068,302 A * 5/2000 Sasse et al. ..... 285/288.1
6,155,046 A * 12/2000 Kato et al. ..... 60/323
6,425,243 B1 * 7/2002 Chen et al. ..... 60/323
7,231,762 B2 * 6/2007 Bassani ..... 60/323
2004/0046391 A1 3/2004 Vasudeva
2004/0135366 A1 7/2004 Sasada et al.
2005/0262836 A1 12/2005 Bassani
2007/0152444 A1 7/2007 Kertesz et al.

* cited by examiner

*Primary Examiner*—David E Bochna
(74) *Attorney, Agent, or Firm*—Kevin M. Welch

(57) ABSTRACT

An apparatus and method of coupling standard exhaust tubing of a circular cross-section with irregular or non-circular exhaust ports of an internal combustion engine in an efficient, economic, and robust manner. The nature of the connection allows for irregular or non-circular exhaust ports to be mated to round tubing with minimal air flow impact and a high strength welded connection, with reduced manufacturing scrap and increased CNC manufacturing capability.

6 Claims, 4 Drawing Sheets

METHOD AND APPARATUS FOR MATING IRREGULAR OR NON-CIRCULAR EXHAUST PORTS WITH TUBING OF A CIRCULAR CROSS SECTION IN EXHAUST FLANGE ASSEMBLIES

FIELD OF THE PRESENT DISCLOSURE

This disclosure relates generally to exhaust flange assemblies, and more particularly to a coupling in exhaust flange assemblies for mating irregular or non-circular exhaust port openings to exhaust tubing of a circular cross-section in an efficient, robust, and economical manner.

BACKGROUND OF THE RELATED ART

Exhaust flange assemblies are typically designed to accept exhaust from single and multiple cylinders of an internal combustion engine and deliver it to an exhaust pipe. Exhaust flange assemblies include a series of headpipes aligned to collect exhaust discharge directly from each cylinder head's exhaust port. The series of headpipes typically converge at the end opposing the exhaust ports to form one tube, sometimes referred to as a collector.

Exhaust flange assemblies are commonly affixed to the cylinder heads of an internal combustion engine via bolts through the flange component of the assembly. The flange is typically designed such that it contains apertures aligned with exhaust ports of equal size and shape so as to allow exhaust gases to pass through the flange upon exit of the exhaust port. On the opposing side of the flange, each aperture is coupled with the influent of a headpipe which thereafter directs the gas flow. The headpipes are typically mandrel bent to a compact orientation so as to accommodate the physical space restrictions of the automotive design.

The fabrication of exhaust flange assemblies designed to accommodate circular exhaust ports is relatively efficient and economical. Headpipes can be bent to shape and cut to length by automated machinery. Assembly involves welding prefabricated components into position, involving relatively little or no skilled manual labor. However, recent developments, including advances in internal combustion engine technology, have led to an increase in engine designs involving irregular or non-circular exhaust ports. This development has increased the time and cost of fabrication by traditional methods.

Mating headpipes to irregular or non-circular exhaust ports presents many challenges. If the cross section of the headpipe terminus does not encompass the entire opening of the exhaust port, engine performance could be significantly affected. One solution practiced in the art includes manually reshaping the mating terminus of each headpipe to accommodate the size and shape of the exhaust port. This process, however, is not preferred because it requires specialized tooling and is very labor and time intensive, thus driving up the cost of production.

Further, manually reshaping the mating terminus of each headpipe may lead to product quality disadvantages. The reshaping process may work-harden or strain-harden the headpipe terminus in a non-uniform manner. This could potentially have a negative effects on the strength and other mechanical properties of the weld. Still further, even if weld quality remains satisfactory, creases and sharp bends in the headpipe terminus made to accommodate the exhaust port size and shape may impede exhaust gas flow thereby impacting engine performance.

The present disclosure distinguishes over the related art providing heretofore unknown advantages as described in the following summary.

BRIEF SUMMARY OF THE INVENTION

The present disclosure describes an improved exhaust flange assembly for efficiently, economically, and robustly mating exhaust tubing of a circular cross-section to irregular or non-circular exhaust ports involving a flange adapted to accommodate the geometric shape of both the exhaust port and the mating terminus of the headpipe.

The flange of the presently disclosed exhaust flange assembly shares some basic similarities with flanges that are known in the art; however, it also contains an innovative coupling that yields many unrealized advantages. The flange comprises an oblong member with two parallel planer surfaces; an anterior surface and a posterior surface. The posterior surface is designed to firmly abut the cylinder heads of an internal combustion engine, separated only by a gasket, as is common in the art. When the posterior surface of the flange is viewed, a plurality of apertures, similarly spaced and of equal shape and size as the exhaust ports of the contemplated internal combustion engine, are visible. Also visible from the posterior surface are a plurality of bolt holes to accommodate bolting the exhaust flange assembly to the internal combustion engine in a traditional manner.

The anterior surface of the flange features a plurality of circular counterbores positioned to encircle and encompass each exhaust port shaped flange aperture. Each counterbore is of a depth of only a portion of the width of the flange. The diameter of each counterbore is nominally larger than the outer diameter of the mating terminus of each headpipe.

This unique design allows each headpipe to be inserted into a corresponding counterbore and welded into place with little or no custom tooling or skilled manual labor. The counterbored flange provides lateral support to the headpipe-flange coupling; therefore, the weld will realize very little lateral stress greatly increasing the strength and durability of the union.

Exhaust flow is not impeded or disturbed so long as the inner diameter of the headpipe is larger than the greatest cross-sectional dimension of the non-circular or irregular shaped exhaust port, so that the entire exhaust port shaped aperture is encompassed within the headpipe influent.

To accommodate exhaust ports with a cross-sectional dimension greater than the standard inner diameter of exhaust tubing, the headpipe influent may be flared to increase its inner diameter. While flaring the headpipe influent is an additional manufacturing step, it can be performed in a uniform manner by automated or semi-automated tools, with an efficiency far greater than manually custom shaping the mating terminus of each headpipe. Flaring can also be done without risk of unwanted creases or sharp bends that often accompany custom shaping methods. The disclosed exhaust flange coupling allows headpipes to be prefabricated as off-the-shelf component parts with little or no customization required during assembly.

The headpipe influent is only flared for a relatively short length; therefore, as the exhaust gases proceed down the headpipe, the inner diameter will return to its standard dimension. This will not create disruptive backpressure so long as the cross-sectional area of the standard unflared exhaust tubing is reasonably equivalent to the area of the exhaust port aperture.

In another embodiment of the present disclosure, the outer surface of the flange may not be fully counterbored to engage the circular cross-section of the headpipe mating terminus. A circular groove may be cut in the anterior surface of the flange positioned to circumscribe the irregular or non-circular exhaust port aperture. The diameter and width of the circular groove must be of appropriate dimensions to accommodate the mating terminus of the headpipe such that it may be inserted into the groove and welded into place. This embodiment may utilize a flared or unflared headpipe depending on the dimensions of the exhaust port geometry.

This disclosure teaches certain benefits in construction and use which give rise to the objectives described below.

A primary objective inherent in the above described method and apparatus is to provide advantages not taught by the prior art.

Another objective is to provide an innovative headpipe-flange coupling for exhaust flange assemblies designed to accommodate irregular or non-circular exhaust ports that are capable of being of fabricated efficiently, reducing cycle time by realizing the advantages of CNC manufacturing.

A further objective is to provide an effective method and apparatus for coupling irregular or non-circular exhaust ports to standard exhaust tubing of a circular cross-section in a robust manner.

A still further objective is to provide a method and apparatus of joining standard exhaust tubing to irregular or non-standard exhaust ports while reducing cost related to scrap, custom tooling, training, and skilled manual labor.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

The accompanying drawings illustrate various exemplary implementations and are part of the specification. The illustrated implementations are proffered for purposes of example not for purposes of limitation. Illustrated elements will be designated by numbers. Once designated, an element will be identified by the identical number throughout. Illustrated in the accompanying drawing(s) is at least one of the best mode embodiments of the present disclosure. In such drawing(s):

DETAILED DESCRIPTION OF THE EXEMPLARY EMBODIMENT

The above described drawing figures illustrate an exemplary embodiment of the joint apparatus and its method of use in at least one of its preferred, best mode embodiments, which is further defined in detail in the following description. Those having ordinary skill in the art may be able to make alterations and modifications to what is described herein without departing from its spirit and scope of the disclosure. Therefore, it must be understood that what is illustrated is set forth only for the purposes of example and that it should not be taken as a limitation in the scope of the present apparatus and method of use.

Figure 1:
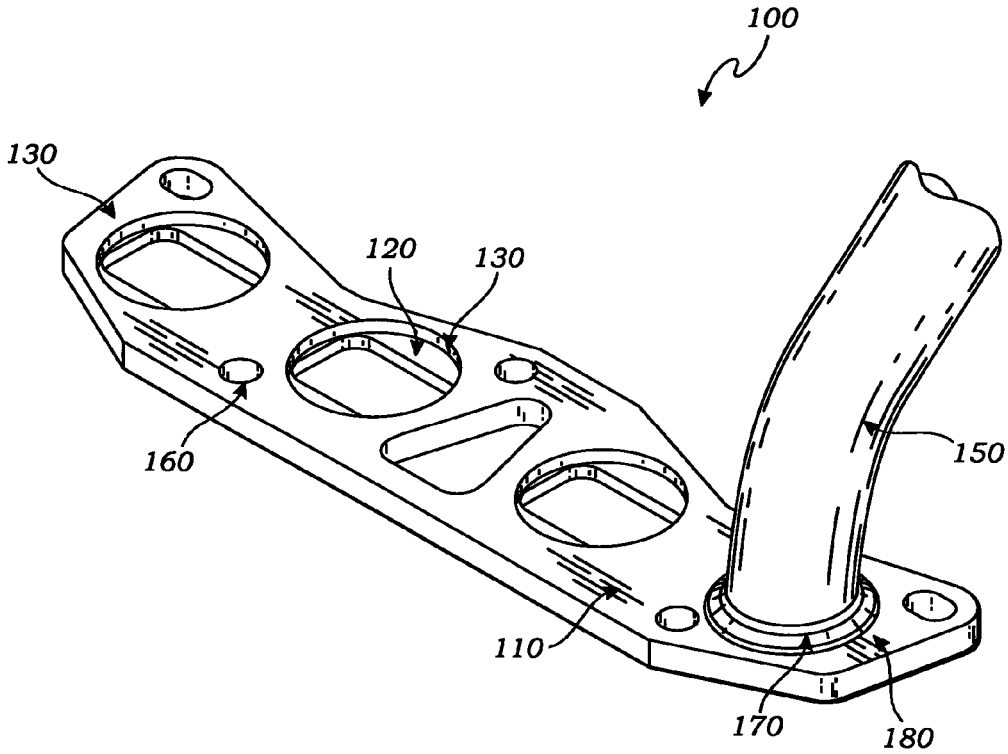
FIG. 1 is a perspective view of an exemplary embodiment of the presently described apparatus.

Described now in detail is an apparatus and method of efficiently, economically, and robustly mating exhaust tubing of a circular-cross section to irregular or non-circular exhaust ports. FIG. 1 is a perspective view of a partially assembled exemplary exhaust flange assembly 100. This figure depicts a plurality of flange apertures 120 similarly spaced and of equal shape and size as the exhaust ports (shown here as rectangular) of the contemplated internal combustion engine. The flange 110 in FIG. 1 depicts one (1) flange aperture 120 coupled to a headpipe 150 and three (3) additional flange apertures 120 that must be adjoined to headpipes 150 prior to assembly completion.

The unassembled flange apertures 120 best illustrate the unique coupling design. On the anterior surface of the flange 110, each flange aperture 120 is encompassed by a circular counterbore 130. The circumference of each counterbore 130 circumscribes the irregular or non-circular flange aperture 120 and is nominally larger than the outer diameter of the mating terminus of the headpipe 150. This construction allows the mating terminus of a headpipe 150 of a circular cross section to be inserted into the counterbore 130 and couple with the flange aperture 120. The headpipe is then affixed by a weld 180 or other sufficient means. Upon coupling, exhaust gases may exit an irregular or non-circular exhaust port, pass through the similarly shaped flange apertures 120, and enter directly into the influent of a headpipe 150, without encountering creases or sharp bends that may encumber the flow of gas.

It is important to the coupling design that the diameter of the counterbore 130 equals or exceeds the greatest length of the flange aperture 120 so that the entire flange aperture 120 is encompassed by the circular counterbore 130. If it is not possible to encompass the entire flange aperture 120 with a counterbore 130 of a diameter equal to the diameter of a standard headpipe 150 cross-section, the headpipe 150 may be flared at its terminus 170 to increase its terminus diameter. If the standard headpipe 150 diameter is large enough to encircle the irregular or non-circular exhaust port, then the flared terminus 170 may not be necessary.

FIG. 1 illustrates a headpipe 150 with a flared terminus 170. However, the flared terminus 170 is only partially visible because the headpipe 150 is inserted into the counterbore 130 and welded 180 to the flange 110.

Once inserted into the counterbore 130, the headpipe 150 can be positioned and welded 180 to the flange 110 relatively quickly with little or no skilled manual labor. This is a great improvement over the solutions that are commonly practiced in the art.

FIG. 1 also illustrates a plurality of small holes 160 for the purpose of bolting the exhaust flange assembly 100 to the cylinder heads of an internal combustion engine. This is accomplished in a traditional manner.

Figure 2:
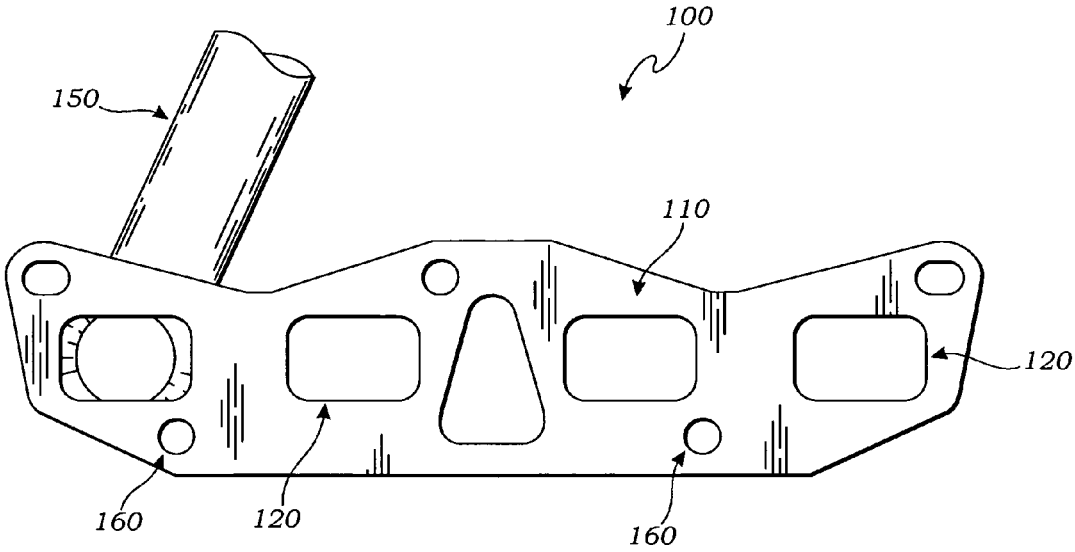
FIG. 2 is a posterior view of an exemplary embodiment of the presently described apparatus.

FIG. 2 is a posterior view of the partially assembled exhaust flange assembly 100. The posterior surface of the flange 110 is designed to abut the exhaust ports of the cylinder heads of an internal combustion engine. The flange apertures 120 are of a similar size, shape, and spacing as the irregular or non-circular exhaust ports of the contemplated internal combustion engine. In FIG. 2, the flange aperture's 120 are rectangular. This is for example only. The flange aperture 120 shape and size may vary as the shape and size of the exhaust ports of the contemplated internal combustion engine varies.

FIG. 2 illustrates the flared headpipe 150 from a unique perspective. The circle seen through the flange aperture 120 is an illustration of the unflared inner wall of the headpipe 150. The area within the rectangular flange aperture 120 and outside the illustrated circle is the inner wall of the headpipe's 150 flared terminus 170. This illustrates that headpipe 150 is flared to reach the diameter necessary to encircle the flange aperture 120 for a very brief length. The flaring enables the headpipe 150 to encircle the flange aperture 120, but is only necessary for a brief transitional length.

Figure 3:
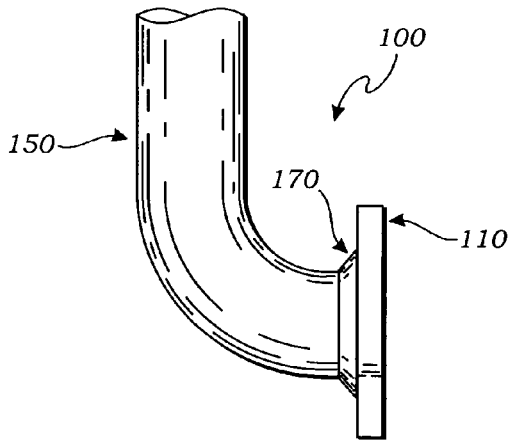
FIG. 3 is a side view of an exemplary embodiment of the presently described apparatus.

FIG. 3 illustrates a side view of the partially assembled exhaust flange assembly 100. This view illustrates another perspective of the flared terminus 170 of the headpipe 150 inserted into the counterbore 130. Once inserted into the counterbore 130 and welded into place, the headpipe 150 is joined very securely to the flange 110. With this unique design, no custom shaping is necessary to mate the headpipe 150 with the flange 110. A major advantage of the disclosed apparatus and method of coupling is the efficiency with which an exhaust flange assembly may be fabricated.

Figure 4:
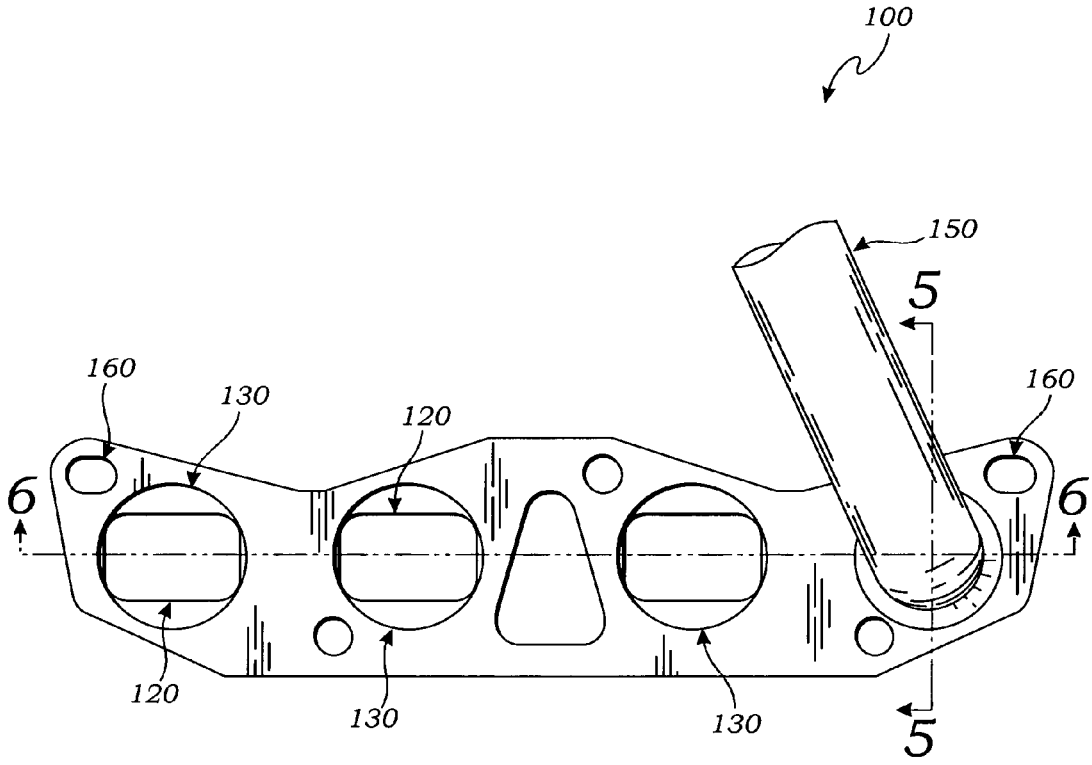
FIG. 4 is an anterior view of an exemplary embodiment of the presently described apparatus indicating planes A-A and B-B.

FIG. 4 is a anterior view of the partially assembled exhaust flange assembly 100. The anterior surface of the flange 110 further illustrates that the circumference of each counterbore 130 circumscribes each flange aperture 120. FIG. 4 also depicts the planes A-A and B-B upon which the cutway views of FIG. 5 and FIG. 6 are based.

Figure 5:
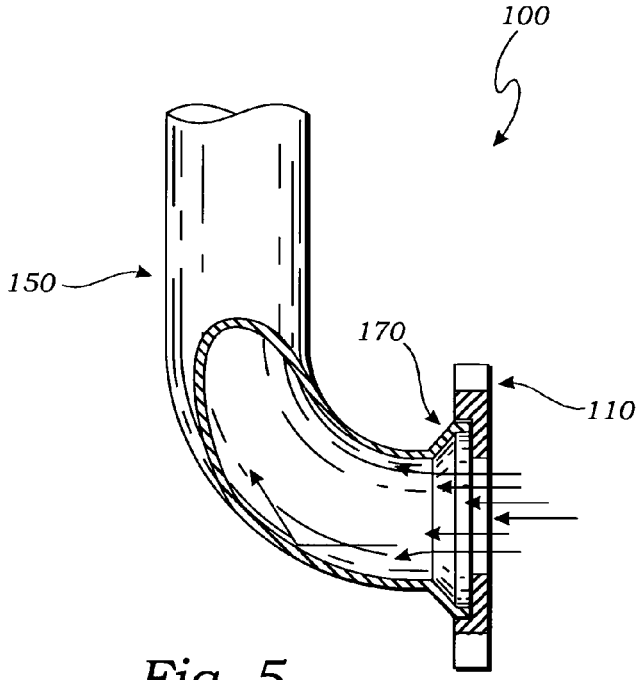
FIG. 5 is a sectional view of an exemplary embodiment of the presently described apparatus along cut along plane A-A defined in FIG. 4.

FIG. 5 is a cutaway view along plan A-A. This view illustrates the coupling of the headpipe 150 with the flange 110 very well. The flared terminus 170 is shown inserted into the counterbore 130. It is apparent from this view that the flange 110 laterally supports the flared terminus 170 of the headpipe 150, once inserted into the counterbore 130. This design results in a robust junction between the headpipe 150 and flange 110. The unnumbered arrows depict the path of exhaust gases as they pass through the flange aperture 120 and into the flared terminus 170 of headpipe 150 and continue down the headpipe 150. The inner wall of the headpipe 150 is smooth as it has not been creased or bent through a manual reshaping process. This allows for unobstructed airflow.

Figure 6:
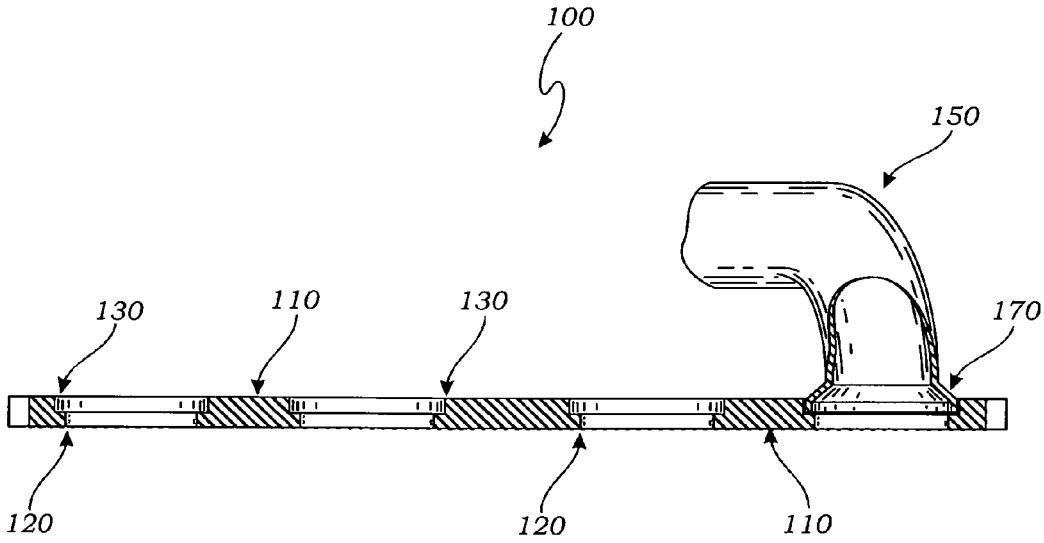
FIG. 6 is a sectional view of an exemplary embodiment of the presently described apparatus along cut along plane B-B defined in FIG. 4.

FIG. 6 is a cutaway view along plane B-B. This view illustrates the flared terminus 170 of the headpipe 150 inserted into the counterbore 130 as well. It is also apparent from this view that the inner diameter of the flared terminus 170 of the headpipe 150 is larger than the flange aperture 120. Utilizing this apparatus and method, each headpipe 150 may be manufactured as an off-the-shelf part, thereby eliminating the need for costly skilled manual labor, and thus reducing the cost of fabrication.

The enablements described in detail above are considered novel over the prior art of record and are considered critical to the operation of at least one aspect of the apparatus and its method of use, and to the achievement of the above-described objectives. The words used in this specification to describe the instant embodiments are to be understood not only in the sense of their commonly defined meanings, but to include by special definition in this specification: structure, material, or acts beyond the scope of the commonly defined meanings. Thus, if an element can be understood in the context of this specification as including more than one meaning, then its use must be understood as being generic to all possible meanings supported by the specification and by the word(s) describing the element.

The definitions of the words or drawing elements described herein are meant to include not only the combination of elements which are literally set forth, but all equivalent structures, materials or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, substitutions, now or later known to one with ordinary skill in the art, are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. An apparatus for mating exhaust tubing of a circular cross-section to irregular or non-circular exhaust ports, the apparatus comprising:

a flange, said flange comprising a posterior and an anterior surface including at least one flange aperture(s) aligned with, and of similar shape and size to an irregular or non-circular exhaust port(s) of a contemplated internal combustion engine, said anterior surface including at least one circular counterbore encompassing said flange aperture;

a length of exhaust tubing, said exhaust tubing having a circular cross-section and at least one terminal end, wherein said length of exhaust tubing is flared to a greater diameter at its terminal end and said terminal end of said exhaust tubing is inserted into said circular counterbore and affixed.

2. An apparatus as in claim 1, wherein said terminal end of said exhaust tubing is affixed to said circular counterbore by a weld between the outer surface of said exhaust tubing and the anterior surface of said flange.

3. An apparatus for mating exhaust tubing of a circular cross-section to irregular or non-circular exhaust ports, the apparatus comprising:

a flange, said flange comprising a posterior and an anterior surface including at least one flange aperture(s) aligned with, and of similar shape and size to, an irregular or non-circular exhaust port(s) of a contemplated internal combustion engine, said anterior surface including at least one circular groove circumscribing said flange aperture;

a length of exhaust tubing, said exhaust tubing having a circular cross-section and at least one terminal end, wherein said length of exhaust tubing is flared to a greater diameter at its terminal end and said terminal end of said exhaust tubing is inserted into said circular groove and affixed.

4. An apparatus as in claim 3, wherein said terminal end of said exhaust tubing is affixed to said circular groove by a weld between the outer surface of said exhaust tubing and the anterior surface of said flange.

5. A method for mating exhaust tubing of a circular cross-section to irregular or non-circular exhaust ports, method comprising the steps of:

(a) boring at least one aperture(s) in a flange, such that it is aligned with and of similar shape and size to an irregular or non-circular exhaust port(s) of a contemplated internal combustion engine;

(b) boring at least one circular shaped counterbore in the anterior surface of said flange, such that said counterbore diameter circumscribes said aperture;

(c) flaring said terminal end of exhaust tubing of a circular cross-section to a diameter greater than the greatest cross-sectional dimension of said irregular or non-circular exhaust port of a contemplated internal combustion engine;

(d) inserting a terminal end of said exhaust tubing into said counterbore;

(e) affixing said terminal end.

6. A method as described in claim 5, wherein step (b) comprises:

(b) boring at least one circular shaped groove on the anterior surface of the said flange, such that said groove circumference circumscribes said aperture.

* * * * *